US007036842B2

(12) United States Patent
Krumbeck et al.

(10) Patent No.: US 7,036,842 B2
(45) Date of Patent: May 2, 2006

(54) RETAINING SYSTEM FOR FRONT AND REAR BOOT HOLDER UNITS OF A BINDING FOR SKIS OR SNOWBOARDS

(75) Inventors: Markus Krumbeck, Garmisch-Partenkirchen (DE); Ludwig Wagner, Farchant (DE)

(73) Assignee: Marker Deutschland GmbH, Eschenlohe (DE)

( * ) Notice: Subject to any disclaimer, the term of this patent is extended or adjusted under 35 U.S.C. 154(b) by 211 days.

(21) Appl. No.: 10/431,224

(22) Filed: May 7, 2003

(65) Prior Publication Data

US 2003/0209881 A1 Nov. 13, 2003

(30) Foreign Application Priority Data

May 7, 2002 (DE) ..... 102 20 483

(51) Int. Cl.
*A63C 9/082* (2006.01)

(52) U.S. Cl. ..... 280/618; 280/633; 280/14.22

(58) Field of Classification Search ..... 280/623, 280/613, 618, 626, 617, 611, 629, 634, 633, 280/14.22

See application file for complete search history.

(56) References Cited

U.S. PATENT DOCUMENTS

| | | | | | |
|---|---|---|---|---|---|
| 3,418,004 | A | * | 12/1968 | Welker | 280/633 |
| 3,531,135 | A | * | 9/1970 | Salomon | 280/633 |
| 4,185,852 | A | * | 1/1980 | Himmetsberger et al. | 280/618 |
| 4,266,806 | A | * | 5/1981 | Weigl et al. | 280/618 |
| 4,302,027 | A | * | 11/1981 | Himmetsberger et al. | 280/618 |
| 4,955,633 | A | * | 9/1990 | Stritzl et al. | 280/633 |
| 5,344,178 | A | * | 9/1994 | Rohrmoser | 280/617 |
| 5,344,179 | A | * | 9/1994 | Fritschi et al. | 280/618 |
| 5,498,017 | A | * | 3/1996 | Rohrmoser | 280/633 |
| 6,092,829 | A | * | 7/2000 | Mercier | 280/617 |

FOREIGN PATENT DOCUMENTS

AT A 1436/2002 9/2002

* cited by examiner

*Primary Examiner*—Hau Phan
(74) *Attorney, Agent, or Firm*—D. Peter Hochberg; Sean Mellino; Katherine R. Vieyra

(57) ABSTRACT

A ski or the like has integrated in it a flat retaining or securing system which bears the boot-retaining units of a binding in an adjustable manner.

16 Claims, 5 Drawing Sheets

RETAINING SYSTEM FOR FRONT AND REAR BOOT HOLDER UNITS OF A BINDING FOR SKIS OR SNOWBOARDS

FIELD OF THE INVENTION

The invention relates to a retaining system for front and rear boot-retaining units of a ski or snowboard binding or the like.

DESCRIPTION OF THE PRIOR ART

In the case of ski bindings which are currently available on the market, the boot-retaining units are usually screwed firmly to the ski, the bores in the ski which accommodate the fastening screws having been introduced into the ski beforehand in accordance with the respective boot size and the pattern of holes necessary in each case for the boot-retaining units.

Furthermore, binding devices for ski rentals are also known in which the boot-retaining units are arranged on base parts such that they can be moved or adjusted in the longitudinal direction of the ski, the base parts themselves being screwed to the ski. In principle, this allows boot-retaining means of the abovementioned type, i.e. those which may also be screwed directly to the ski, to be arranged on the base parts.

Also known are skis with rails which are integrated in the ski structure and into which boot-retaining units which are adapted to the rails can be pushed or inserted.

SUMMARY OF THE INVENTION

The object of the invention, then, is to design skis or the like, such that, once fitted on the ski, conventional bindings, which up until now have been screwed directly to the ski, remain adjustable in adaptation to the respective boot size.

This object is achieved according to the invention by a retaining or securing system which can be integrated in a sunken manner in a ski or a snowboard, has a flat structure and is intended for front and rear boot-retaining units which interact with front and rear regions respectively of a boot. The system can have front and rear base parts which can be displaced longitudinally in a single-part or multi-part guideway on the ski or snowboard and which accommodate and/or secure the front and rear boot-retaining units. Also included in the system can be connecting rods, which are fastened on the base parts, and are essentially parallel to the guideway and extend in the direction of the respectively other base part, and a fixing device, which interacts with the connecting rods, locks the connecting rods simultaneously to the ski or snowboard, or releases them simultaneously, and, when actuated, results in elevations and/or recesses on the connecting rods and matching elevations and/or recesses of the fixing device, with horizontal relative movement approximately parallel to the top side of the ski or snowboard, engaging in one another with locking action and/or moving apart in order to release one another.

The invention is based on the general idea of a base arrangement, which serves for adjustably securing the boot-retaining units of a ski binding or of a binding for snowboards; this base arrangement is designed as a flat structure in order to make it easier for it to be arranged in a sunken manner in the ski or snowboard or to be integrated in the ski or snowboard structure. In particular, this makes it possible for the base arrangement to be embedded in the laminate which typically forms the snowboard or ski structure. The desirable flat construction is aided to a considerable extent in that, for locking and/or unlocking the connecting rods in the fixing device, all that is necessary is to have horizontal relative movements parallel to the top side of the ski or snowboard taking place between interacting locking and mating locking parts. A large amount of space is available in this movement direction on a ski or snowboard, with the result that reliable and deep locking engagement is possible, to be precise even when the connecting rods are configured flexibly or have a thin vertical profile to give the ski or snowboard improved deflection properties.

Furthermore, it is advantageous for it to be possible for the flat structure according to the invention to be connected to the ski or snowboard over a large surface area and, accordingly, such that it can be subjected to high loading and can withstand significant loads.

According to a preferred embodiment of the invention, it is provided that the connecting rods, on the one hand, and the fixing parts of the fixing device cooperating therewith, on the other hand, are provided, in the plane perpendicular to the top side of the ski or snowboard, with protrusions and set-back portions which can be brought into locking engagement with one another.

The connecting rods are particularly expediently designed as flat strips with a toothed longitudinal border which interacts with an essentially mating toothing formation on parts of the fixing device. In addition to simplicity of design, high flexibility of the connecting rods is achieved here.

According to a first embodiment, the two connecting rods may be arranged one beside the other in the same horizontal plane, if a particularly flat construction is sought.

It is then possible for the connecting rods to be toothed on their longitudinal borders which are remote from one another and to cooperate with a cam which is arranged between the connecting rods. In a rotary position, with engagement of the toothing formations on the connecting rods in stationary mating toothing formations of the fixing device, the cam can spread the connecting rods apart from one another.

Alternatively, it is also possible for moveable fixing parts, which are provided with a toothing formation fitting into the toothed longitudinal borders of the connecting rods and which are arranged such that they can be displaced transversely to the connecting rods in a direction parallel to the top side of the ski or snowboard and such that they are essentially fixed to the ski or snowboard in the longitudinal direction of the connecting rods, to be retained, by means of a cam, in locking engagement with the connecting rods in one rotary position of said cam and in a released state in another rotary position thereof.

According to an alternative embodiment, it is also possible for the two connecting rods to be arranged one above the other and to interact, by way of toothed borders located one above the other, with a correspondingly toothed mating locking part of the fixing device.

To facilitate simple or straightforward operation, it may be expedient if the front and the rear base parts are positively coupled to one another in terms of movement such that, when one base part is displaced in one direction, the other base part is displaced to a corresponding extent in the opposite direction. This ensures that the base parts are displaced symmetrically in relation to a "boot center".

Since, however, it may also be desirable to be able to move the boot center relative to the ski or snowboard, an arrangement without synchronization of the base-part movements is also advantageous since, in this case, it is also possible for the base parts to be adjusted in the same direction or by different lengths or distances.

It is always expedient for gearing elements which are provided for the synchronized movements of the base parts to be arranged separately from the connecting rods and the fixing device. As a result, the abovementioned synchronizing means need only absorb the low displacement forces which occur during adjustment of the base parts, and need not absorb the much greater retaining forces which occur during skiing or snowboarding. Moreover, it is then also possible, without adversely affecting the safety of the retaining system, for the synchronizing means to be designed such that the synchronizing action may be cancelled by the at least temporary removal of a synchronizing means.

In addition, regarding preferred features, one is referred to the claims and to the following description of the drawing, by way of which particularly advantageous embodiments of the invention are described in more detail.

DESCRIPTION OF THE PREFERRED EMBODIMENT

Figure 1:
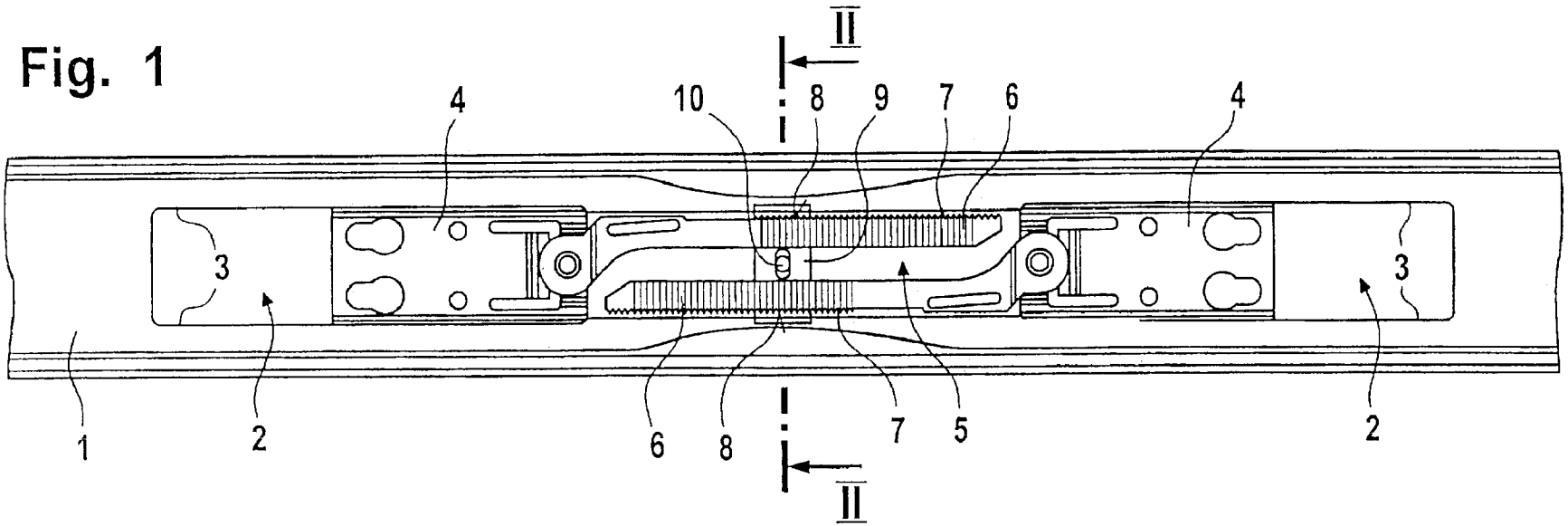
FIG. 1 shows a plan view of a first embodiment of the retaining system according to the invention.
Figure 2:
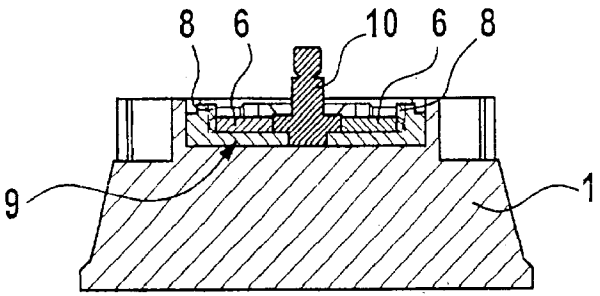
FIG. 2 shows a section along section line II—II in FIG. 1.

In the embodiment of FIGS. 1 and 2, essentially rectangular depressions 2 are arranged in the top side of a central section of a ski 1, the longitudinal borders of said depressions being designed as guide rails 3 or being formed by guide rails 3. The guide rails 3 are, for example, in the form of C-profiles which have their open concave sides directed toward one another.

Each of the depressions 2 accommodates a base plate 4, which is guided in a displaceable manner in the guide rails 3 of the respective depression 2. Each base plate 4 has a pattern of holes such that a front or rear boot-retaining unit of a basically conventional ski binding can be fastened on each base plate 4. Together with the base plates 4 which bear them, the boot-retaining units can then be displaced in the longitudinal direction of the ski in the depressions 2 or in the guide rails 3, which bound the depressions 2 on the longitudinal sides.

Arranged in the ski 1, between the depressions 2, is a channel 5 which connects the depressions 2 and may be closed off on its top side by a ski-mounted covering (not illustrated).

Two flat-strip-like connecting rods 6 are accommodated, one beside the other in a common plane within the channel, and are each connected to one of the base plates 4. For example, the bottom connecting rod 6 in FIG. 1 is connected to the base plate 4 which is on the right-hand side of FIG. 1, while the other connecting rod 6 is fastened on the base plate 4 which is on the left-hand side in FIG. 1.

On their longitudinal borders which are remote from one another, the connecting rods 6 are each provided with a toothing formation 7, which each allow engagement in mating toothing formations 8 of a fixing body 9 which is fixed to the ski. The fixing body 9 essentially comprises a sole or bearing plate which is fixed to the bottom or floor of the channel 5 and/or has been lowered into the bottom of the channel 5 and on which are integrally formed upwardly angled side borders which, on their mutually facing sides, are provided with the abovementioned toothing formations 8. The side borders are accommodated in corresponding recesses of the side walls of the channel 5 such that it is only the teeth of the toothing formations 8 which project, beyond the plane of the side walls of the channel 5, into the channel interior.

A cam 10 is mounted for rotation on the sole plate of the fixing body 9, in the center between the connecting rods 6, and, in its position which is illustrated in FIGS. 1 and 2, retains the connecting rods 6 in a state in which their toothing formations 7 engaged in the toothing formations 8 of the fixing body 9. If the cam 10 is rotated through 90°, the connecting rods 6 obtain a sufficient clearance in order to move out of the toothing formations 8 of the fixing body 9 by way of their toothing formations 7.

The connecting rods 6 are preferably connected resiliently to the respective base plate 4, or supported resiliently on the side walls of the channel 5, such that they try to move out of the toothing formations of the fixing body 9 by way of their toothing formations 7. This results in the toothing formations 7 and 8 disengaging from one another, and remaining disengaged from one another, when the cam 10 is rotated through 90° in relation to the position illustrated in FIGS. 1 and 2, and remains in this rotated position.

Accordingly, it is then possible for the base plates 4 and/or the boot-retaining units of the ski binding, which are arranged thereon, to be displaced in the longitudinal direction of the ski for adaptation to the respective size of the ski boot or ski-boot sole. Furthermore, it is also possible for the two base plates 4 and/or the boot-retaining units arranged thereon to be displaced in the same direction in order to shift the position of the ski boot on the ski in the direction of the front end of the ski or in the direction of the rear end of the ski.

As soon as the cam 10 is rotated back again into the position illustrated, the connecting rods 6 are inevitably pushed, by way of their toothing formations 7, into the toothing formations 8 of the fixing body 9 and, accordingly, the base plates 4 are secured in the longitudinal direction of the ski relative to the fixing body 9, although the base plates 4, and thus the boot-retaining units, can execute longitudinal displacement movements relative to the ski 1, for example when the ski 1 flexes.

Figure 3:
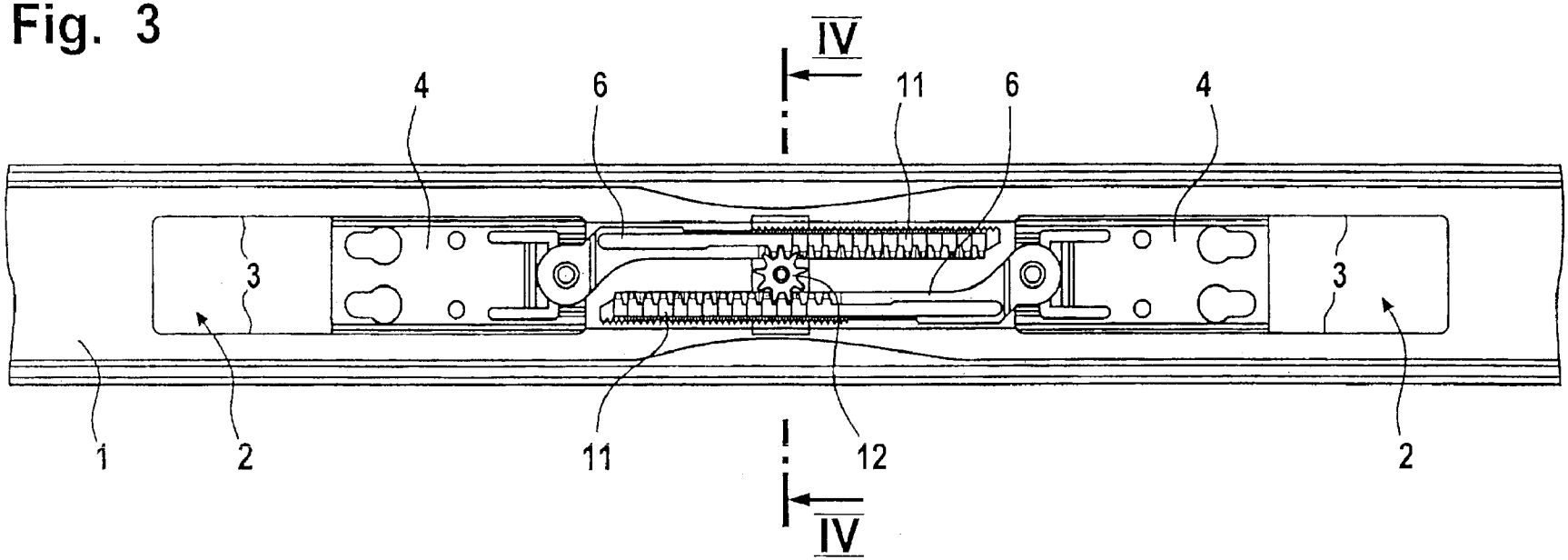
FIG. 3 shows a plan view of a second embodiment.
Figure 4:
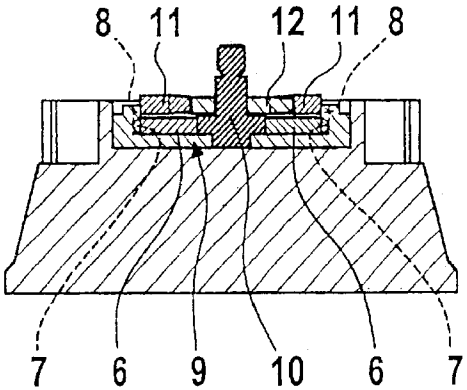
FIG. 4 shows a section along section line IV—IV in FIG. 3.

The embodiment illustrated in FIGS. 3 and 4 differs from the embodiment of FIGS. 1 and 2 essentially in that each of the base plates 4 is connected to racks 11 which, in the example illustrated, are arranged above the connecting rods 6 and are each connected to one of the connecting rods 6 such that each toothed rack 11, together with its connecting rod 6, forms a leg spring, wherein the leg formed by the toothed rack is tensioned or braced against the adjacent side wall of channel 5 and the leg formed by the respective connecting rod 6 is tensioned or braced against the cam 10.

Toothed racks 11, having much coarser teeth than the toothing formations 7 and 8, are positively coupled to one another via a gearwheel 12, which is mounted in a rotatable manner on the axle of the cam 10, i.e. toothed racks 11 can only be moved in opposite directions to one another in the longitudinal direction of the ski.

When the cam 10 is rotated through 90° from the locking position illustrated, the connecting rods 6 move out of the toothing formations 8 of the fixing body 9 by way of their toothing formations 7, and the connecting rods 6 and thus the base plates 4 can be displaced in the longitudinal direction of the ski. Because of the positive coupling of the racks 11 via the gearwheel 12, the base plates 4, and accordingly the boot-retaining units of the ski binding which are arranged thereon, can only be displaced at the same time and in opposite directions.

The connecting rods 6 thus serve, in conjunction with the fixing body 9 and the cam 10, to fix and/or unlock the base plates 4 and the ski-binding elements arranged thereon. The racks 11, in conjunction with the gearwheel 12, cause the base plates 4, and the ski-binding elements fastened thereon, to be displaced simultaneously when the base plates 4 are unlocked.

Figure 5:
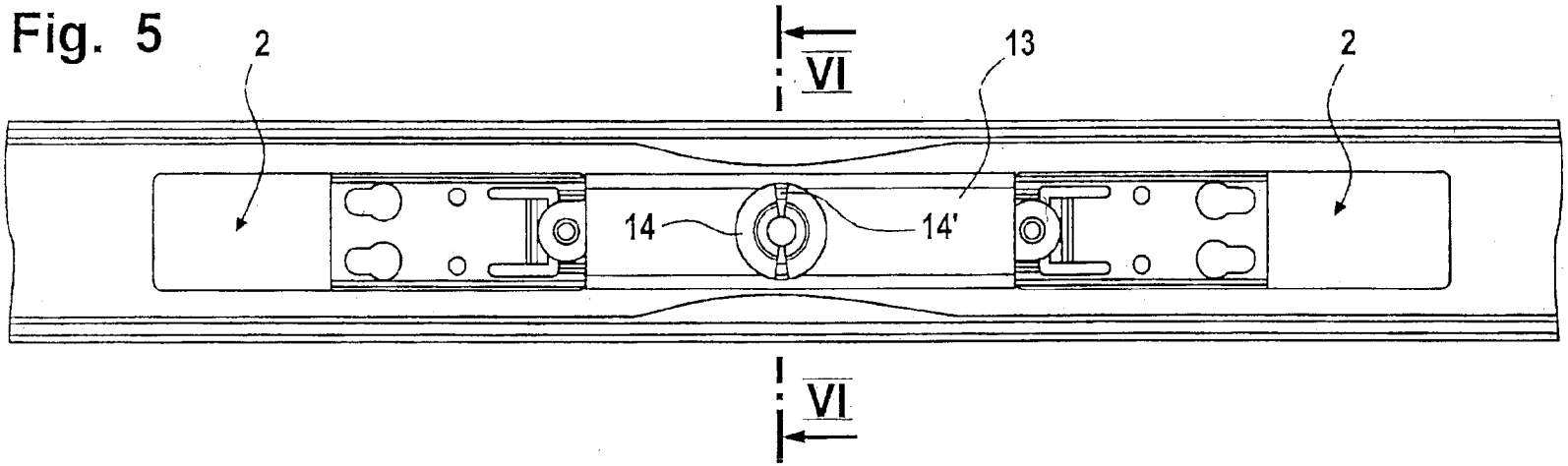
FIG. 5 shows a plan view of a third embodiment.
Figure 6:
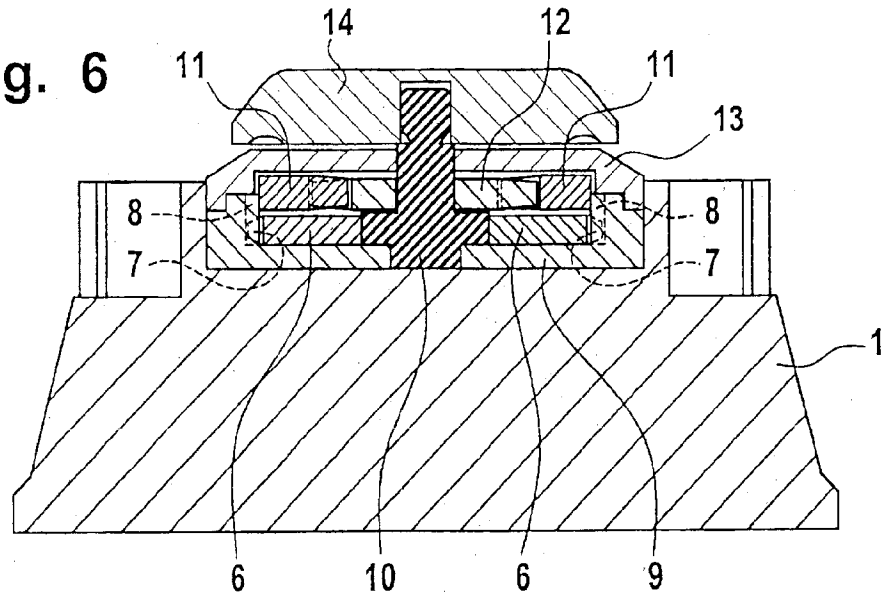
FIG. 6 shows a section along section line VI—VI in FIG. 5.

As is illustrated by way of example in FIGS. 5 and 6, a covering 13 may be arranged above the channel 5 between the depressions 2, with the result that the connecting rods 6 and the racks 11 are concealed and are not visible on the outside of the ski 1. The axle of the cam 10 passes through a corresponding opening in the covering 13 and is connected in a rotationally fixed manner to a handwheel 14 above the covering 13. This handwheel, for its part, is provided with markers or pointer symbols 14' or the like. When these pointer symbols 14' are oriented in the transverse direction of the ski according to FIG. 6, the cam 10 is also oriented in the transverse direction of the ski and, accordingly, retains the toothing formations 7 of the connecting rods 6 in engagement with the toothing formations 8 of the fixing body 9. If the handwheel 14 is rotated through 90°, the cam 10 releases the connecting rods 6, and the base plates 4, with the boot-retaining units of the ski binding which are arranged thereon, can be displaced, though only a coupled displacement of the base plates 4 in opposite directions is possible if the racks 11 and the gearwheel 12 are provided, i.e., in the example of FIGS. 5 and 6, are arranged beneath the covering 13.

Figure 8:
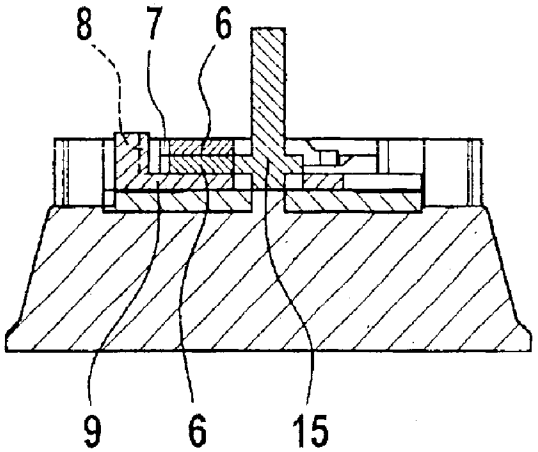
FIG. 8 shows a section along section line VIII—VIII in FIG. 7.
Figure 7:
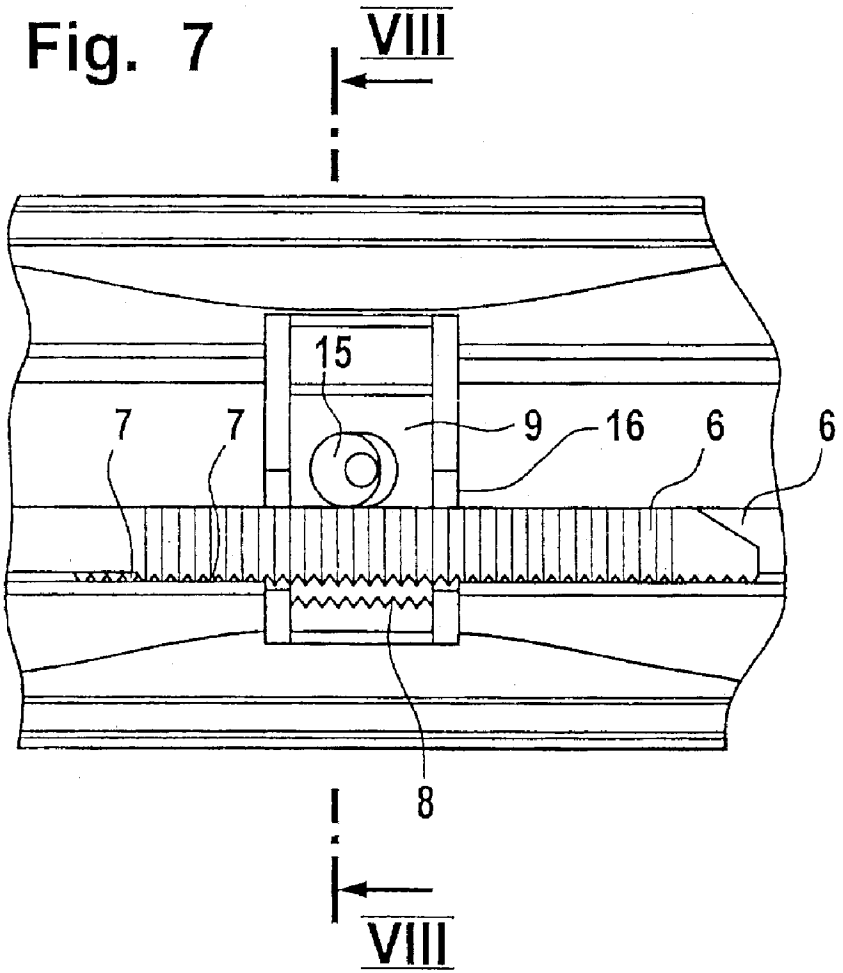
FIG. 7 shows a plan view of part of a fourth embodiment.

In the case of the embodiment of FIGS. 7 and 8, the connecting rods 6 of the base plates 4 are arranged one above the other to the side of the longitudinal axis of the ski and are provided with toothing formations 7 which are located vertically one above the other and interact with the toothing formation 8 of a fixing body 9, which can be moved in the transverse direction of the ski and interact with a cam 15.

The fixing body 9 is guided such that it can be displaced in the transverse direction of the ski in a ski-mounted sliding guide 16 and is secured such that it cannot be moved in the longitudinal direction of the ski. The cam 15 has a bottom section which is mounted for rotation in a recess of the movable fixing body 9; the cam 15 also has a top part, which is eccentric to its bottom part and butts against those longitudinal sides of the connecting rods 6 which are remote from the toothing formations 7 thereof.

If the cam 15 is rotated through 90° in the counterclockwise direction from its position which is illustrated in FIG. 7, the displaceable fixing body 9 in FIG. 7 is displaced upward relative to the connecting rods 6, with the result that the toothing formation 8 of the fixing body 9 engages in the toothing formations 7 of the connecting rods and fixes the latter in the longitudinal direction of the ski relative to the sliding guide 16.

In order to ensure that the toothing formation 8 of the fixing body 9, which can be moved in the transverse direction of the ski, moves away from the toothing formation 7 of the connecting rods 6 in that position of the cam 15 which is illustrated in FIG. 7, it is possible to provide a spring (not illustrated) which tries to push the movable fixing body 9 upward in FIG. 7.

Figure 9:
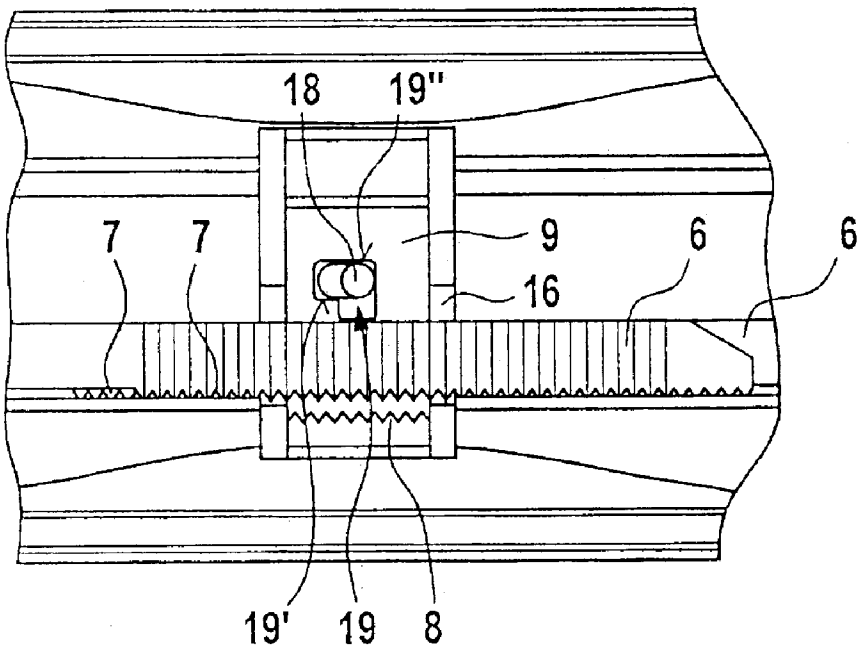
FIG. 9 shows a plan view of part of a fifth embodiment.

The embodiment of FIG. 9 differs from the embodiment of FIGS. 7 and 8, in particular, in that a cam 18 is mounted for rotation in a ski-mounted bearing (not illustrated specifically) and interacts, by way of its cam part, with a guide slot 19 formed in the moveable fixing body 9. In addition, the connecting rods 6, within the channel 5, are guided, on their longitudinal borders which are remote from their toothing formations 7, on guide elements such that they can only be moved in the longitudinal direction of the ski, but not in the transverse direction of the ski.

In one position, the cam 18 interacts with a region 19' of the guide slut 19 such that the moveable fixing body 9 is laterally moveable in a linear path and is retained in a position, or as brought into a position by lateral movement, in which the toothing formation 8 of the fixing body 9 has been disengaged from the toothing formations 7 of the connecting rods 6. In a position rotated through 90° in the clockwise direction, the cam 18 interacts with a section 19" of the guide slot 19 such that the moveable fixing body 9 is retained in a position, or is moved into a position, in which the toothing formation 8 of the fixing body 9 engages in the toothing formations 7 of the connecting rods 6 and the latter are secured in the longitudinal direction of the ski.

Figure 10:
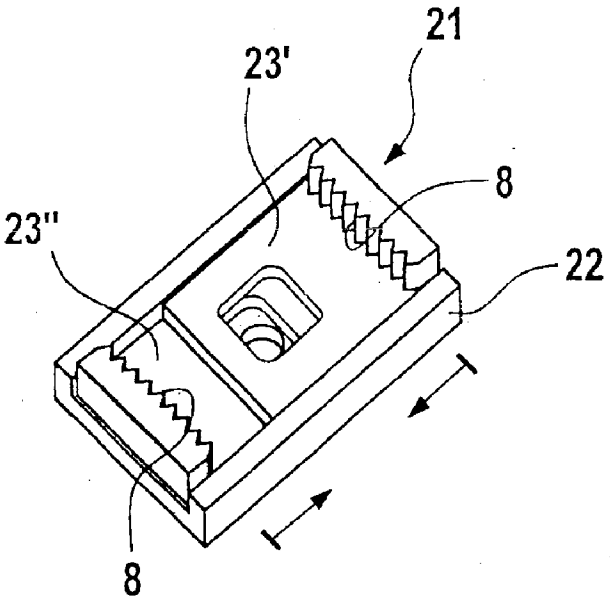
FIG. 10 shows an alternative to the embodiment of FIGS. 1 and 2.

In contrast to the embodiment which is illustrated in FIGS. 1 and 2, and in the situation wherein the fixing body 9 is non-movable and the connecting rods 6 can be moved in the transverse direction of the ski by way of their toothing formations 7, it is also conceivable, in principle, to have an embodiment in which the connecting rods 6 are guided such that they cannot be moved in the transverse direction of the ski and the fixing device 21 provided is one which, according to FIG. 10, has two fixing bodies 23' and 23" which can be moved in the transverse direction of the ski in a ski-mounted sliding guide 22. By virtue of a cam (not illustrated), which is mounted for rotation in the sliding guide 22 and has cam parts which interact with guide slots in the fixing bodies 23' and 23", it is then possible for the fixing bodies 23' and 23", by way of their toothing formations 8, to be simultaneously disengaged from the toothing formations 7 of the connecting rods 6 or, for the purpose of fixing the connecting rods 6, engaged in the toothing formations 7 thereof.

What is claimed is:

1. A retaining system having a flat surface for front and rear boot-retaining units cooperating with respective front and rear regions of a boot, said system mountable on the upper surface of a ski or a snowboard or integrally recessable in a ski or a snowboard, said system comprising:

a guideway on the ski or snowboard, said guideway selected from one of a single part guideway and a multiple part guideway;

front and rear base parts displaceable longitudinally in said guideway, said base parts accommodating or securing the respective front and rear boot-retaining units;

connecting rods fastenable to the base parts, said rods having recesses and elevations and said rods being essentially parallel to the guideway and extending in the direction of the respectively other base part; and a fixing device being laterally movable in a linear path and having elevations and recesses, wherein:

said elevations and recesses of said fixing device engage said recesses and elevations of said connecting rods, releasably locking the connecting rods at the same time to the ski or snowboard with horizontal relative movement approximately parallel to the top side of the ski or of the snowboard.

2. The retaining system as claimed in claim 1, wherein the connecting rods have projecting elevations and set-back depressions in the plane perpendicular to the surface of the ski or snowboard, and the fixing device has fixing parts having projecting elevations and set-back depressions in the plane perpendicular to the surface of the ski or snowboard, wherein said projecting elevations and set-back depressions of said connecting rods lockingly engaged said projecting elevations and set-back depressions of said fixing parts.

3. The retaining system as claimed in claim 1, wherein said ski or snowboard has at least one of moveable elevations, set-back portions, and fixing elements and said moveable elevations, set-back portions, and fixing elements interact with the connecting rods.

4. The retaining system as claimed in claim 1, wherein said ski or snowboard has at least one of rigid elevations, set-back portions, and fixing elements, and the connecting rods can be adjusted transversely to the longitudinal direction of the rods.

5. The retaining system as claimed claim 1, further comprising gearing elements between the base parts said gearing elements being separate from the connecting rods and said gearing elements synchronize the movements of the base parts, with the result that the connecting rods can only be displaced together and in opposite directions to one another.

6. The retaining system us claimed in claim 1, wherein the connecting rods are flat strips with a toothed longitudinal border which interacts with an essentially mating toothing formation on the fixing device.

7. The retaining system as claimed in claim 1, wherein the two connecting rods are arranged in a common plane such that they are spaced apart from one another transversely to the longitudinal direction.

8. The retaining system as claimed in claim 1, wherein the connecting rods are toothed on their longitudinal borders, said borders being remote from one another.

9. The retaining system as claimed in claim 8, further comprising a cam having a rotary position, said cam interacts with the facing borders of the connecting rods and, in said rotary position, said cam spreads the connecting rods apart from one another and brings toothing formations on the connecting rods into engagement with mating toothing formations on the fixing device.

10. The retaining system as claimed in claim 9, wherein moveable fixing parts essentially fixed to the ski in the longitudinal direction of the connecting rods, having a toothing formation fitting into the toothed longitudinal borders of the connecting rods can be displaced transversely to the connecting rods in a direction parallel to the top side of the ski, said cam retains said parts in locking engagement with the connecting rods in one rotary position of said cam and in a released state in another rotary position of said cam.

11. A retaining system having a flat surface for front and rear boot-retaining units cooperating with respective front and rear regions of a boot, said system mountable on the upper surface of a ski or a snowboard or integrally recessable in a ski or a snowboard, said system having a central, longitudinal axis and comprising:

a guideway on the ski or snowboard, said guideway selected from one of a single part guideway and a multiple part guideway;

front and rear base parts displaceable longitudinally in said guideway, said base parts accommodating or securing the respective front and rear boot-retaining units;

flat strip-like, generally coplanar connecting rods fastenable to the base parts extending in a longitudinal direction in a parallel relation on opposite sides of the longitudinal axis, said rods having laterally extending recesses and elevations and said rods being essentially parallel to the guideway and extending in the direction of the respectively other base part; and a flat fixing device being laterally movable in a linear path transverse to said connecting rods and being generally coplanar with said connecting rods, and having a pair of parallel sets of elevations and recesses, parallel respectively to said recesses and elevations on said connecting rods, said elevations and recesses of said fixing device being engagable with said recesses and elevations of said respective connecting rods in response to lateral movement of said fixing device towards said connecting rods for releasably locking the connecting rods at the same time to the ski or snowboard.

12. The retaining system as claimed in claim 11, wherein the lateral movement of said flat fixing device is along a linear path.

13. The retaining system according to claim 11 and further including structure for effecting the lateral movement of said fixing device, said structure comprising a slot in one of said flat fixing device and the object over which said fixing device moves, and a cam mounted on the other of said flat fixing device and said object, said fixing device having the path of movement determined by said cam and said slot.

14. The retaining system as claimed in claim 11, and further including structure for preventing lateral movement of said fixing device for preventing the engagement of said elevations and recesses of said fixing device with recesses and elevations of said connecting rods.

15. The retaining system as claimed in claim 11 and including structure for preventing the engagement of said elevations and recesses of said fixing device with recesses and elevations of said connecting rods, said structure comprising a slot in one of said flat fixing device and the object over which said flat fixing device moves, and a cam mounted on the other of said flat fixing device and said abject, said slot being spaced from the place of engagement of said respective elevations and recesses, and said cam and slot preventing said engagement.

16. A retaining system according to claim 11, wherein the ski or snowboard have longitudinal edges, and said recesses and elevations of said connecting rods extend laterally away from the longitudinal axis and towards the closest longitudinal edge of the ski or snowboard, and the respective elevations and recesses of said fixing device extend towards the longitudinal axis.

* * * * *